United States Patent [19]

Mosier et al.

[11] 4,040,252

[45] Aug. 9, 1977

[54] CATALYTIC PREMIXING COMBUSTOR

[75] Inventors: Stanley A. Mosier, North Palm Beach; Robert M. Pierce, Tequesta, both of Fla.

[73] Assignee: United Technologies Corporation, Hartford, Conn.

[21] Appl. No.: 653,811

[22] Filed: Jan. 30, 1976

[51] Int. Cl.[2] ..... F02C 7/22

[52] U.S. Cl. ..... 60/39.36; 60/39.65; 60/39.71; 60/39.82 C

[58] Field of Search ..... 60/39.65, 39.71, 39.82 C, 60/39.36, 39.69

[56] References Cited

U.S. PATENT DOCUMENTS

| | | | |
|---|---|---|---|
| 1,278,499 | 9/1918 | Esnault-Pelterie | 60/39.65 |
| 2,498,728 | 2/1950 | Way | 60/39.65 |
| 2,720,753 | 10/1955 | Sharpe | 60/39.65 |
| 3,846,979 | 11/1974 | Pfefferle | 60/39.65 |
| 3,943,705 | 3/1976 | DeCorso et al. | 60/39.65 |

FOREIGN PATENT DOCUMENTS

| | | | |
|---|---|---|---|
| 662,785 | 12/1951 | United Kingdom | 60/39.65 |

*Primary Examiner*—Carlton R. Croyle
*Assistant Examiner*—Robert E. Garrett
*Attorney, Agent, or Firm*—Jack N. McCarthy

[57] ABSTRACT

This disclosure sets forth a combustion device for a power plant wherein a burner includes a central tubular section with an annular section located therearound. Air inlet means directs air to the burner. The central section comprises a premixing chamber and a combustion chamber for burning a fuel-air mixture while the annular section includes a catalytic reaction device. First tubular means directs air inwardly to said central tubular section for mixing with fuel where the fuel-air mixture is then burned. Additional air is added through second tubular means to the exhaust therefrom where it is then directed to one end of the annular section containing the catalytic reaction device. A transition member connects the exhaust end of the annular section to an outlet. Cooling louvers can be provided along this section if necessary. Further, a swirling device is located between the premixing chamber and combustion chamber for greater mixing of fuel and air.

8 Claims, 1 Drawing Figure

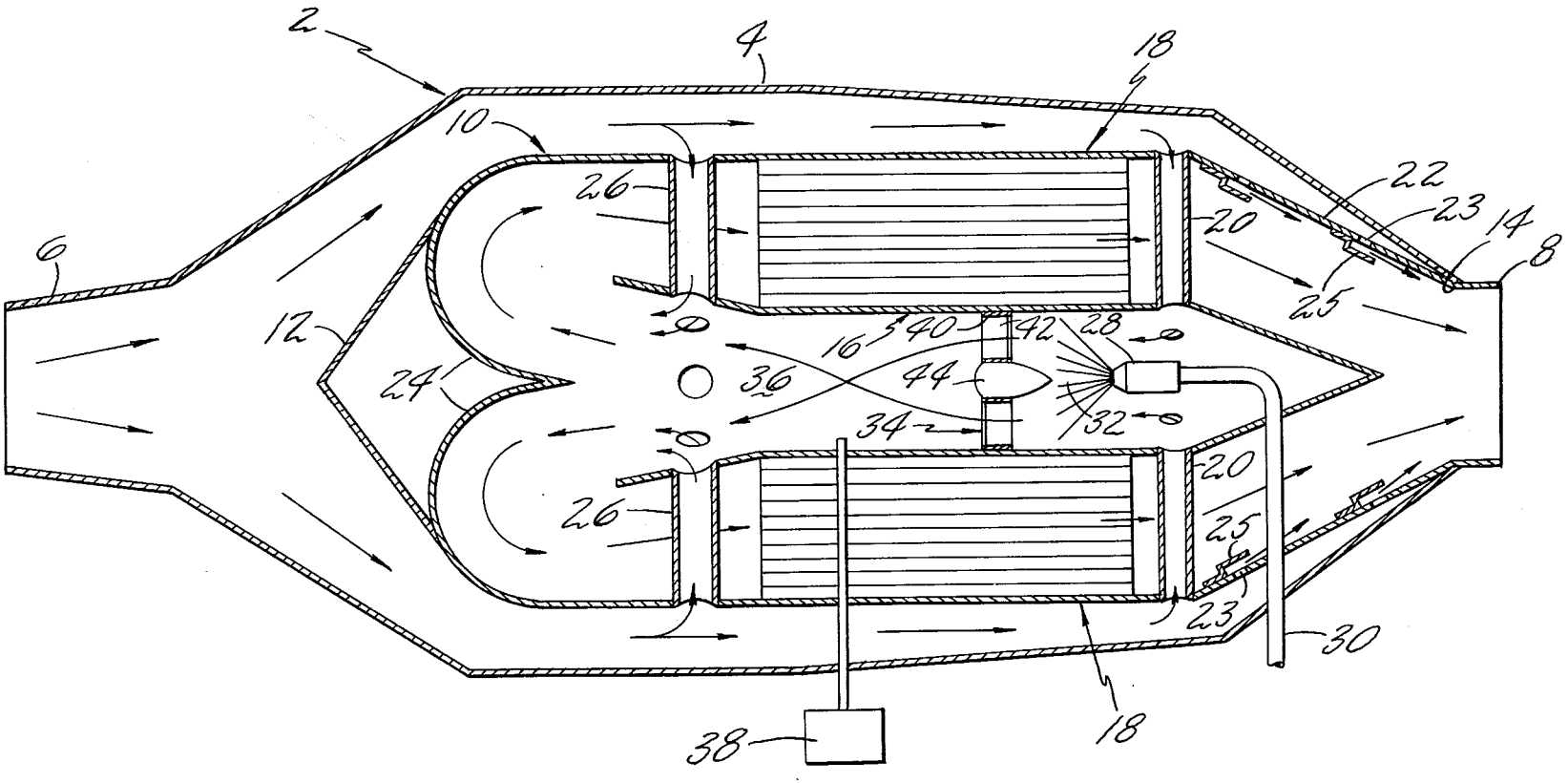
8
14
23
22
25
20
18
4
2
10
26
24
12
6
16
36
40
42
44
34
28
32
30
38

CATALYTIC PREMIXING COMBUSTOR

The invention herein described was made in the course of, or under, a contract with the Department of the Air Force.

BACKGROUND OF THE INVENTION

While fuel-air combustion chambers and catalytic reaction devices have been used together before, as shown in U.S. Pat. Nos. 3,797,231 and 3,846,979, the arrangement described herein is believed to define thereover.

There are two primary classes of objectionable gaseous exhaust emissions that are of concern with relation to gas turbine engine burner operation. The first is the low temperature class in which carbon monoxide (CO) and unburned hydrocarbons (UHC) are components. These species persist in exhaust gas from burners because the temperature within the burner was too low for the combustion reaction to be completed in which the CO and UHC would have been completely oxidized to carbon dioxide ($CO_2$) and water ($H_2O$). The second class is the high-temperature class in which the oxides of nitrogen ($NO_x$) are components. These species persist in exhaust gas from burners because the temperature within the burner was too high and the nitrogen and oxygen in the air reacted together. In general, means incorporated to control low-temperature pollutants increase concentrations of the high-temperature species, and means incorporated to control high-temperature species increase concentrations of the low-temperature species. Both low and high-temperature species can be controlled if the temperature in the burner can be controlled. The ideal operating temperatures within which pollutant control can be accomplished is 2200°–3050° F. Below 2200° F, carbon monoxide ceases to further oxidize to carbon dioxide. The temperature 2200° F is referred to as the kinetic "freezing point" temperature for carbon monoxide. Above 3050° F, the rate of formation of the oxides of nitrogen increases rapidly with temperature; at temperatures of 3050° F and below, the rates of formation of the oxides of nitrogen are low and, consequently the concentrations of $NO_x$ in the burner exhaust gas are low.

SUMMARY OF THE INVENTION

A combustor arrangement for a power plant is disclosed having a tandem, self-regulating arrangement wherein a combustion chamber for burning a fuel-air mixture is placed in line with a catalytic reaction device. This arrangement provides for low concentrations of objectionable exhaust emissions and high values of combustion efficiency over the entire operating range of the power plant. The combustion chamber, or primary burner, in which fuel and air are burned, provides for the efficient, low pollution burning of fuel and air at low values of fuel/air ratios and at low values of inlet air temperature and pressure, and the catalytic reaction device, or secondary burner, in which a well mixed flow of the exhaust gas from the primary burner and additional air, enter and react on the surface of an oxidation-selective solid catalyst, provides for the efficient low pollution burning of the fuel-air mixture from the primary burner at higher values of fuel/air ratios.

In accordance with the present invention, a combustion device for a power plant includes a central tubular section with an annular section located therearound, said central tubular section comprises a combustion chamber for burning a fuel-air mixture while the annular section includes a catalytic reaction device. Fuel and air are directed to one end of said tubular section while the other end is connected to the annular section. Additional air is directed into the central tubular section adjacent its connection to the annular section.

BRIEF DESCRIPTION OF THE DRAWING

The FIGURE is a longitudinal sectional view of the combustion section for a gas turbine power plant.

DESCRIPTION OF THE PREFERRED EMBODIMENT

The FIGURE shows a combustion section 2 of a gas turbine power plant, with the power plant being an engine of the conventional type described in greater particularity in U.S. Pat. No. 2,747,367.

The combustion section 2 is formed having an annular burner casing 4 with an annular inlet 6 to receive airflow from a compressor section and an annular outlet 8 for directing flow to a turbine section. A plurality of burner cans 10 are fixedly located around the interior of the annular burner casing 4. Since each of the burner cans 10 are similar only one will be described.

Each burner can 10 is formed having a closed forward end 12 with an open rearward end having an annular opening 14 which cooperates with the annular outlet 8. The burner cans 10 are positioned so that airflow from a compressor section completely surrounds each of the burner cans. Each burner can 10 has a central tubular section 16 with an annular section 18 located therearound. Tubes 20 are located at the rearward end of the annular section 18 and connect the outer surface thereof to the rearward end of the central tubular section 16, providing primary airflow thereto. The rearward end of the tubular section 16 is closed by the interior of a transition section 22 which connects the rear end of the annular section 18 to one location around the annular opening 14. Each transition section 22 has cooling holes 23 therein, and louvers 25 increase the effectiveness of the airflow therethrough.

The forward part of the tubular section 16 is flared outwardly and opens into a domed section 24 which connects the forward end of the tubular section 16 to the annular forward end of the annular section 18 while reversing the flow. Tubes 26 are located at the forward end of the annular section 18 and connect the outer surface thereof to the forward end of the central tubular section 16, providing additional airflow thereto.

The rearward portion of the central tubular section 16 has a fuel nozzle 28 positioned just forwardly of the inner openings of the tubes 20. The fuel nozzle is attached by known means and has fuel directed thereto by a conduit 30. Conventional fuel controls are used for directing fuel to the fuel nozzles. The rearward portion of the central tubular section 16 forms a precombustion, premixing chamber 32 for aiding in mixing of the fuel and air. A swirling device 34 is located in the central tubular section to provide for further mixing of the fuel and air before it enters the forward portion of the central tubular section 16 which is formed as a combustion chamber or zone 36. An ignition means 38 is provided to ignite this mixture. The swirling device 34 comprises a short cylinder 40 having a plurality of vanes 42 extending radially outwardly thereto from a small center body 44. The vanes 42 are placed at an angle to provide a swirling action on the fuel-air mixture passing through the swirling device 34.

The annular section 18 of the burner can 10 between the tubes 20 and tubes 26 is formed as a catalytic reaction device. The design of the catalytic device does not form part of this invention and can be one of many designs available from manufacturers. U.S. Patents cited above disclose various catalysts. U.S. Pat. No. 3,846,979 states that flow channels in a honeycomb structure can be used. This type of construction can be used here.

A general description of operation is set forth below as an example:

A portion of airflow entering inlet 6, said portion corresponding to 1.0 equivalence ratio in the premixing chamber 32 at 0.004 overall fuel/air ratio is admitted through the primary air tubes 20. The equivalence ratio of a fuel-air mixture is defined as the fuel/air ratio of interest divided by the stoichiometric fuel/air ratio. For example, the equivalence ratio of a mixture of JP4 fuel and air, whose fuel/air ratio is 0.035, is equal to 0.035/0.068 or 0.51. Very efficient combustion is maintained in the tubular combustion chamber 36, aided by good fuel-air mixture preparation in the premixing chamber 32, and effective flame stabilization provided by the swirling device 34 at overall fuel/air ratios in the vicinity of 0.004. The lean-blowout fuel/air ratio resulting from this method of operation would be very low (0.002 or lower).

All the remaining airflow, with the exception of a small amount for cooling, is added through the additional air tubes 26 at a single site or plane. This causes a relatively abrupt cooling of the reactants and products of combustion leaving the combustion chamber 36. At very low overall fuel/air ratios, e.g. 0.004, when the equivalence ratio in the combustion chamber 36 is near unity, this abrupt addition of dilution air quenches the combustion process and, in particular, terminates the formation of $NO_x$. At these operating conditions, UHC concentrations are nearly zero because of near-optimum burning conditions (equivalence ratio near unity) in the combustion zone. Some freezing of CO will occur in the dilution area adjacent the ends of tubes 26; however, because of the low quantities of fuel being burned, and the presence of the catalyst downstream, overall exit concentrations would be very low.

As the overall fuel/air ratio is increased from 0.004, premixing chamber 32 and combustion chamber 36 effectively undergo a transition from a combustion device to a fuel preparation device. This is desirable because of the operating characteristics of the catalytic reaction device. Typically, catalysts of the type that would be employed in this combustor have active operating temperature limits from 750° F to approximately 2500° F. Below 750° F, catalyst conversion efficiency is relatively low; above 750° F the efficiency is essentially 100%. Above 2500° F, the catalyst structure can be weak. The premixing chamber 32 and combustion chamber 36, functioning as a combustion device, heats the gas flow entering the catalyst to approximately 750° F at low overall fuel/air ratios. Assuming a representative combustor inlet air temperature of 300° F at idle, the catalyst inlet temperature is 600° F at 0.004 fuel/air ratio, and 750° F at 0.006 fuel/air ratio. At fuel/air ratios above 0.006 it is desirable to phase out the combustion reaction in the combustion chamber 36, and phase in the catalytic reaction. This occurs automatically because of increasing equivalence ratios in the combustion zone. At a 0.006 fuel/air ratio, the combustion zone equivalence ratio is 1.5; at 0.008 fuel/air ratio, it is 2.0; and at 0.012 fuel/air ratio, it is 3.0. Combustion efficiency will decline as equivalence ratio increases and at some point above 3.0, rich blowout in the combustion chamber will occur. During this transition process, the combustion chamber 36 becomes a progressively "dirtier" burner, with concentrations of unburned hydrocarbons and CO increasing sharply. At the same time, however, declining combustion efficiency is offset by an increase in ideal temperature rise (as fuel/air ratio increases), and an increase in air temperature at inlet 6 (as engine RPM increases), and the catalyst inlet temperature is maintained above 750° F. Under these conditions the catalyst acts to clean up the "dirty" combustion chamber exhaust products. After rich blowout occurs, temperatures at inlet 6 will have increased to near 750° F, and the catalyst will function efficiently without prior heating of the reactant. In this regime of operation, the combustion chamber 36 and premixing chamber 32 serve as fuel-preparation devices (i.e. premixing, prevaporization). Any preflame reactions or inefficient combustion that persists under these conditions is an added bonus, because "dirty" exhaust products represent ideal fuel-air mixture preparation for the catalyst device. $NO_x$ concentrations are very low throughout the entire operating range described, because of very rich combustion, rapid quenching, and the near-zero $NO_x$ output from the catalyst.

We claim:

1. A combustion device for a power plant including in combination a burner can, said burner can including a central tubular section, an annular section located therearound, said central tubular section having an open end and a closed end, means for directing air around said burner can, first tubular means connecting the exterior of said burner can to the interior of said central tubular section adjacent its closed end to direct air thereto, opening means connecting the exterior of said burner can to the interior of said central tubular section adjacent its open end to direct air thereto, means connecting the open end of said central tubular section to the adjacent end of said annular section, transition duct means connects the other end of said annular section to an outlet, said central tubular section including a combustion chamber, means for injecting fuel into the interior of said central tubular section adjacent its closed end, means for igniting the fuel-air mixture formed in said combustion chamber, said annular section including a catalytic reaction device.

2. A combination as set forth in claim 1 wherein a flow swirling means is located in said central tubular section for swirling the fuel-air mixture prior to combustion.

3. A combination as set forth in claim 1 wherein a plurality of said burner cans are positioned within an annular casing, said transition duct means connecting the other ends of said annular sections of said burner cans to an annular outlet.

4. A combination as set forth in claim 1 wherein said combustion chamber is located between said means for injecting fuel and the connection of said second tubular means to said central tubular section.

5. A combination as set forth in claim 1 wherein said transition duct means has openings therein for directing air from around said burner can therethrough for cooling.

6. A combination as set forth in claim 1 wherein said first tubular means comprises a plurality of tubes connecting the exterior of said burner can to the interior of said central tubular section downstream of the rear of the catalytic reaction device.

7. A combination as set forth in claim 1 wherein said second tubular means connects the exterior of said burner can to the interior of said central tubular section adjacent the end of the combustion chamber.

8. A combustion device for a power plant including in combination a combustion chamber for burning a fuel-air mixture, a premixing chamber located upstream of said combustion chamber for receiving fuel and air, means directing air to said premixing chamber, means for directing a fuel to said premixing chamber, a catalytic reaction device is located downstream of said combustion chamber for receiving flow therefrom, means for directing air into the flow between said combustion chamber and the catalytic reaction device so that dilution air is provided at low fuel/air ratios of burning in the combustion chamber to freeze formation of $NO_x$ and dilution air is provided at high fuel/air ratios of burning in the combustion chamber to reduce the temperature of the exhaust and prevent overheating the catalytic reaction device, outlet means for directing flow from said catalytic reaction device, said means for directing air to said premixing chamber comprising tubes passing across said outlet means in the path of flow leaving the catalytic reaction device.

* * * * *